United States Patent [19]

Tinsler

[11] Patent Number: 4,471,633

[45] Date of Patent: Sep. 18, 1984

[54] CONDENSING UNIT

[75] Inventor: Theodore E. Tinsler, Sidney, Ohio

[73] Assignee: Copeland Corporation, Sidney, Ohio

[21] Appl. No.: 302,791

[22] Filed: Sep. 16, 1981

Related U.S. Application Data

[63] Continuation of Ser. No. 45,790, Jun. 5, 1979, abandoned.

[51] Int. Cl.[3] ..... F25D 19/00

[52] U.S. Cl. ..... 62/295; 62/298; 62/277

[58] Field of Search ..... 62/297, 294, 295, 428, 62/429, 262, 466, 298, 277; 248/670, 671, 672, 673, 674, DIG. 13

[56] References Cited

U.S. PATENT DOCUMENTS

| | | |
|---|---|---|
| 2,626,509 | 1/1953 | Morrison . |
| 2,927,442 | 3/1960 | Kooiker . |
| 2,952,995 | 9/1960 | Brannick . |
| 2,955,439 | 10/1960 | Pinter . |
| 2,979,918 | 4/1961 | Atchison . |
| 3,079,766 | 3/1963 | Abbott et al. . |
| 3,079,768 | 3/1963 | Abbott . |
| 3,079,769 | 3/1963 | Abbott . |
| 3,116,615 | 1/1964 | Harle . |
| 3,486,347 | 12/1969 | Gidseg . |
| 3,524,329 | 8/1970 | Smith et al. . |
| 3,679,867 | 7/1972 | Canter . |
| 3,724,233 | 4/1973 | Pugh et al. . |
| 3,727,421 | 4/1973 | Berg . |
| 3,766,749 | 10/1973 | Livesay . |
| 4,107,939 | 8/1978 | Bolton et al. . |
| 4,136,529 | 1/1979 | McCarty . |
| 4,206,611 | 6/1980 | Lang et al. . |

FOREIGN PATENT DOCUMENTS 66993 9/1975 Canada ..... 62/262

OTHER PUBLICATIONS

Copeland Brochure, Criterion 80, pp. 13 and 14.

*Primary Examiner*—Albert J. Makay
*Assistant Examiner*—Henry Bennett
*Attorney, Agent, or Firm*—Harness, Dickey & Pierce

[57] ABSTRACT

There is disclosed herein an improved supporting base for refrigeration condensing units which is non-corrosive and includes integral provisions for securing different size refrigeration compressors and associated condensers, as well as an optional receiver. The supporting base also includes a condensate receiving reservoir and means for holding the compressor discharge line beneath the level of condensate therein. The mounting provisions are designed to position the condenser and compressor above the maximum condensate level so as to reduce the likelihood of resulting corrosion thereof and to effectively prevent condensate leakage therefrom.

8 Claims, 9 Drawing Figures

FIG. 1.
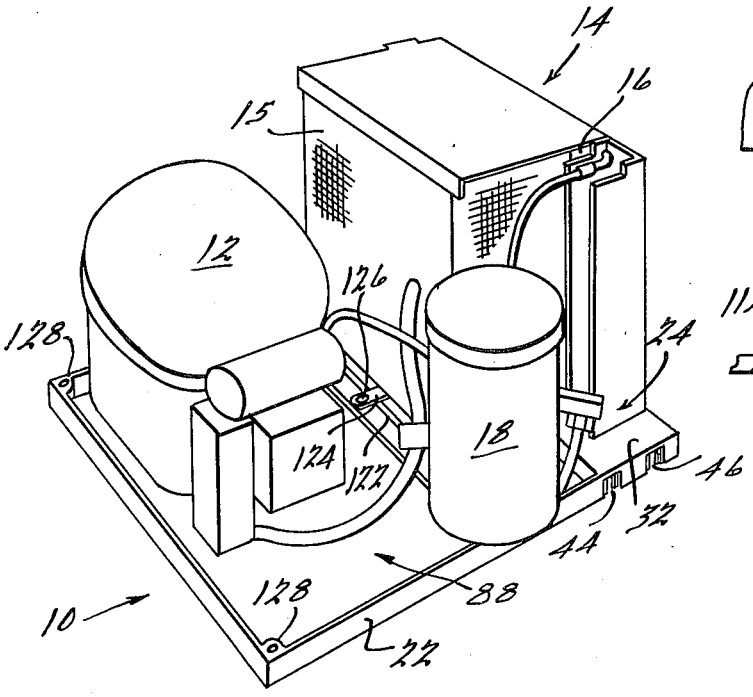
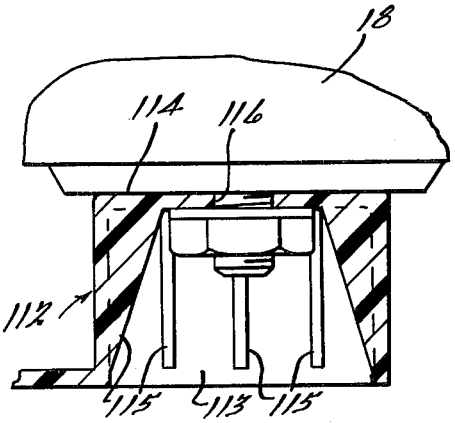
FIG. 8.
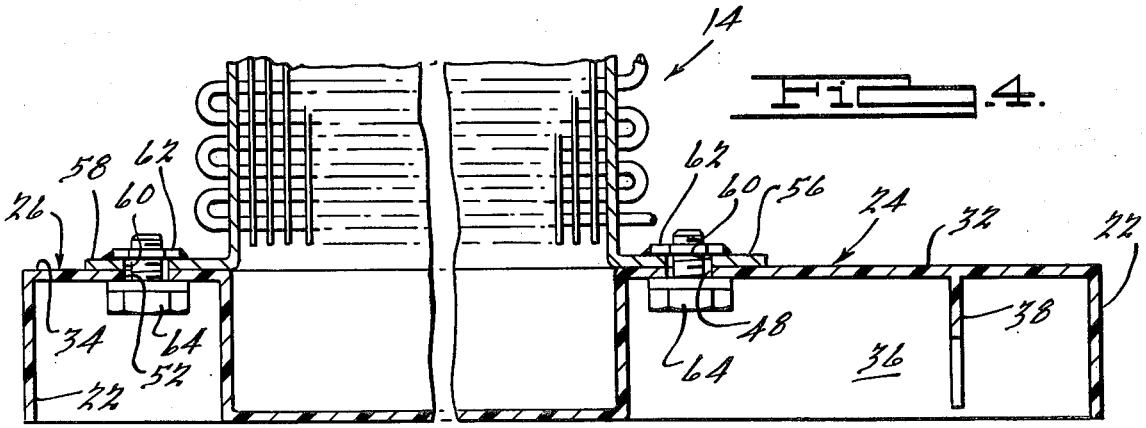
FIG. 4.
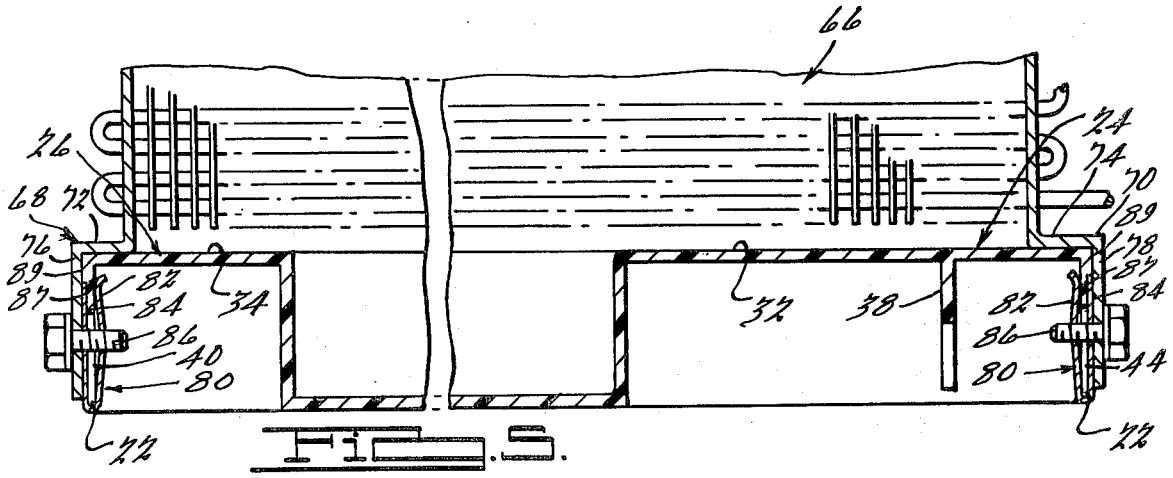
FIG. 5.

FIG. 7.
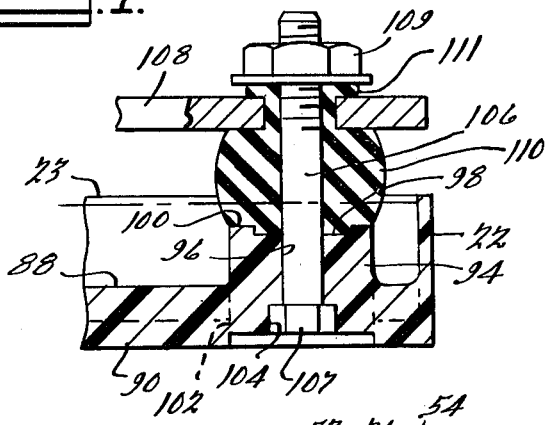
FIG. 9.
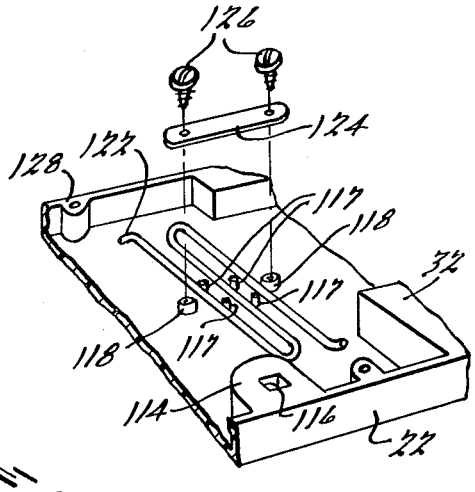
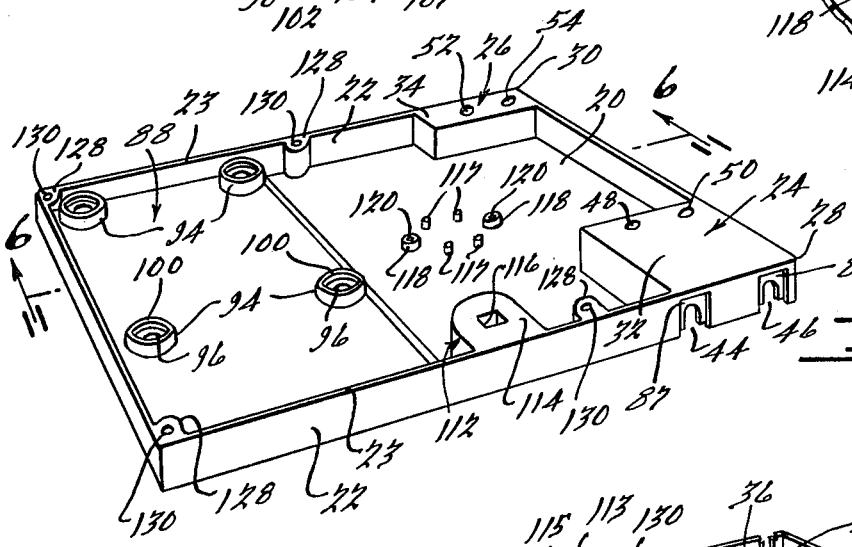
FIG. 2.
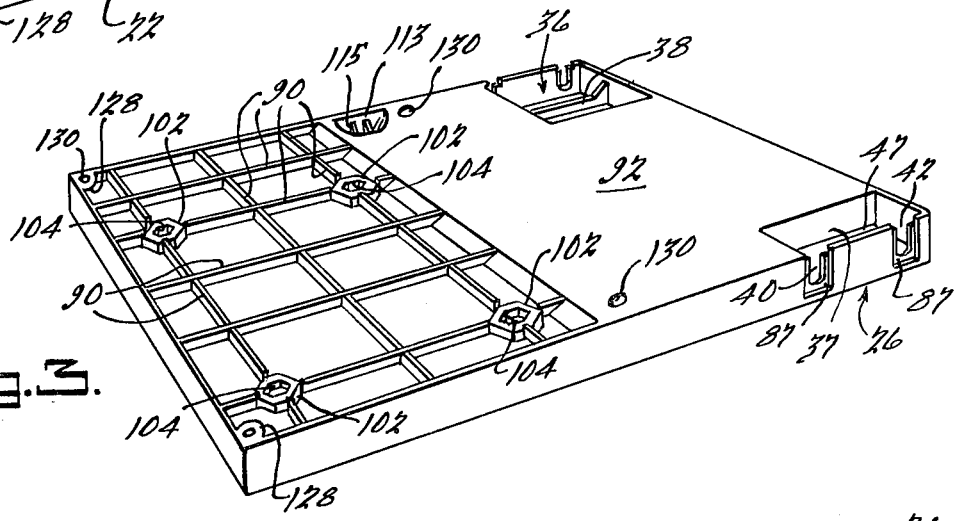
FIG. 3.
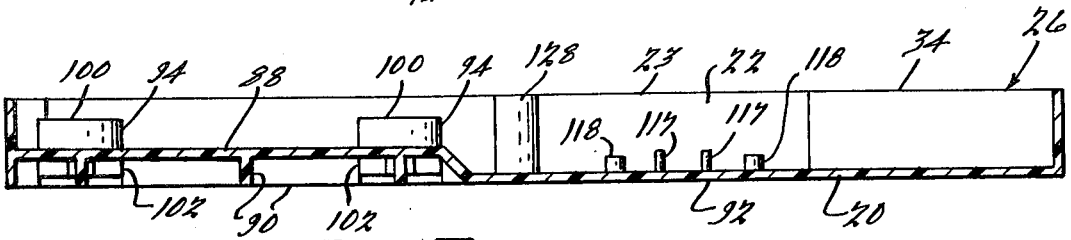
FIG. 6.

CONDENSING UNIT

This is a continuation of application Ser. No. 45,790, filed June 5, 1979, now abandoned.

BACKGROUND AND SUMMARY OF THE INVENTION

The present invention relates generally to mounting apparatus for refrigeration systems and more specifically to supporting bases to which condensing units may be secured.

In refrigeration systems employing a compressor, condenser, and an evaporator it is common practice to mount the compressor and condenser in close proximity to each other with the evaporator being positioned at a location remote therefrom and within the area to be refrigerated. The compressor and condenser may each be secured to a portion of an enclosure surrounding them or to a supporting framework which may then be removably secured to the equipment with which it is to be used or a separate enclosure. In any event, the supporting structures employed heretofore have commonly been fabricated from sheet metal or metal channel members with suitable openings provided therein to accommodate mounting bolts or the like. In some applications the supporting structure may also include a condensate reservoir either in the form of a separate pan or integrally formed therewith. However, in that the structures are generally fabricated from metal, the presence of condensate therein may give rise to corrosion problems eventually requiring replacement of the supporting structure. Further, in order to secure the compressor and condenser to the supporting structure, openings must be provided for bolts or the like thus creating the potential for condensate leakage or additional time and labor must be expended to fabricate and weld or otherwise secure various brackets.

Accordingly, the present invention provides a noncorrosive supporting base fabricated from a polymeric material having an integrally formed condensate reservoir provided which base is specifically designed to enable a compressor, condenser and associated accessories to be secured thereto so as to form a unitized package which may be easily installed and removed from equipment with which it is to be used. Further, the supporting base includes raised mounting platforms and mounting means for both condenser and compressor to elevate these components above the maximum condensate level. Also, both the compressor mounting means and the condenser mounting platforms are designed to enable different sized compressors and condensers to be secured thereto so as to enable a single size supporting base to be utilized for a variety of different capacity refrigeration systems. Further, the use of a polymeric material for the supporting base enables it to be easily and rapidly fabricated at relatively low cost. The base also includes provisions for securing the compressor discharge line within the condensate reservoir. This enables useful work to be obtained from the condensate by recooling compressed refrigerant flowing to the condenser while also heating the condensate and thereby eliminating the need to provide separate heating means to promote evaporation of the condensate.

Additional advantages and features of the present invention will become apparent from the subsequent description and the appended claims taken in conjunction with the accompanying drawings.

BRIEF DESCRIPTION OF THE DRAWINGS

FIG. 1 is a perspective view of a supporting base having a refrigeration compressor, a condenser and associated equipment secured thereto all in accordance with the present invention;

FIG. 2 is another perspective view of the supporting base of FIG. 1 but with the refrigeration equipment removed therefrom;

FIG. 3 is a perspective view of the supporting base of FIGS. 1 and 2 with the base being inverted;

FIG. 4 is a transverse sectional view of the supporting base showing a portion of a condenser assembly secured thereto, the section being taken along a plane passing transversely through said condenser;

FIG. 5 is a sectional view similar to that of FIG. 4 but showing a portion of another condenser secured to alternate mounting provisions provided on the supporting base all in accordance with the present invention;

FIG. 6 is a sectional view of the supporting base of FIG. 2, the section being taken along line 6—6 thereof;

FIG. 7 is an enlarged fragmentary view of a portion of the supporting base of FIG. 1 showing a portion of a compressor secured thereto;

FIG. 8 is an enlarged fragmentary view of an accessory mounting provision provided on the supporting base of FIG. 1 in accordance with the present invention; and FIG. 9 is an enlarged fragmentary view showing the compressor discharge conduit secured within the condensate reservoir of the supporting base.

DESCRIPTION OF THE PREFERRED EMBODIMENT

Referring now to the drawings and in particular to FIG. 1, there is shown a supporting base in accordance with the present invention indicated generally at 10 having a refrigeration compressor 12, a condenser assembly 14 including a motor driven fan (not shown) enclosed within a fan screen 15 and a condenser coil 16, and a receiver 18 all secured in operative relationship thereto.

Refrigeration compressor 12 and condenser assembly 14 as well as receiver 18 will all be of conventional construction with refrigeration compressor 12 conventionally being of the hermetic type although other types may be easily utilized.

As best seen with reference to FIGS. 2 and 3, supporting base 10 is generally rectangular in shape, is formed from a suitable polymeric material, and includes a bottom wall 20 surrounded by integrally formed upwardly extending flange portion 22 extending around the periphery thereof. Flange portion 22 and bottom 20 cooperate to define a condensate reservoir within supporting base 10 having a maximum level equal to the top edge 23 of flange portion 22. A pair of spaced generally rectangular shaped raised condenser mounting platforms 24 and 26 are integrally formed adjacent corners 28 and 30 at one end of base 10. Preferably platforms 24 and 26 will each have upper surfaces 32 and 34 positioned in coplanar relationship to the top edge 23 of peripheral flange portion 22. As shown in FIG. 3, bottom wall 20 is cut out or notched in the areas underlying platforms 24 and 26 thereby defining cavities 36 and 37 respectively. Platform 24 is slightly larger than platform 26 and has a reinforcing rib 38 extending across cavity 36. A pair of spaced generally U-shaped slots 40 and 42 are also provided in flange portion 22 below platform 26 and a similar pair of spaced generally U-shaped slots 44 and 46 are provided in flange portion 22 below platform 24, each of which open outwardly along the bottom edge 47 thereof and into respective cavities 36 and 37. Also, platforms 24 and 26 are each provided with a pair of spaced openings 48, 50, and 52, 54 in respective upper surfaces 32 and 34.

As shown in FIG. 4, condenser assembly 14 has a pair of outwardly extending spaced generally coplanar flange portions 56 and 58 each of which are provided with a pair of openings 60 alignable with respective openings 48, 50, 52, and 54 of support platforms 24 and 26. Each opening 6C has a threaded member 62 secured thereto in a suitable manner such as by welding which member is adapted to receive a threaded fastener 64 extending through respective openings 48-54 and 60 so as to enable condenser assembly 14 to be supportingly secured to respective surfaces 32 and 34 of base member 10.

Referring now to FIG. 5, should a larger capacity refrigeration system be desired a larger condenser assembly will be required. Base member 10 is specifically designed to accommodate such a larger condenser thereby eliminating the need to manufacture and stock separate base members for each different size refrigeration system. Condenser assembly 66 is provided with a pair of depending flange portions 68 and 70 each including outwardly extending supporting portions 72 and 74 and downwardly extending securing portions 76 and 78 respectively. A plurality of fasteners are provided each comprising a spring clip 80 having a pair of generally parallel leg portions 82 and 84 which grasp opposite surfaces of flange portion 22 and an opening provided in leg portion 82 designed to receive and threadedly retain a bolt 86 extending through suitable openings provided in respective securing portions 76 and 78 of flange portions 68 and 70 and respective U-shaped slots 40, 42, 44, and 46. Preferably a recessed portion 87 will be provided surrounding each of the U-shaped slots 40, 42, 44, and 46 so as to enable leg portion 84 to be positioned flush with outer surface 89 of flange portion 22. This will also enable securing forces to be distributed over the entire surface area engaged by securing portions 76 and 78 thereby reducing the possibility of stress cracking of the plastic composition base. Thus, as bolts 86 are tightened, flange portion 22 will be clamped between leg portion 82 and securing portions 76 and 78.

In order to provide sufficient rigidity and strength to base member 10 to enable it to properly support the weight of the refrigeration compressor, compressor mounting portion 88 of bottom wall 20 is elevated slightly so as to enable a plurality of reinforcing ribs 90 to be accommodated on the under surface thereof, the outer ends of which are positioned in substantially coplanar relationship to bottom surface 92. A plurality of generally cylindrical compressor mounting pads 94 are also provided being integrally molded with base member 10 and extending upwardly from portion 88 of bottom wall 20. Preferably four such mounting pads 94 will be provided each of which is substantially identical and includes a bore 96 extending therethrough and an enlarged diameter shallow annular recess 98 in the upper surface 100 thereof. An annular wall portion 102 surrounds the lower end of each bore 96 and defines an enlarged preferably hexagonal shaped opening 104 therein.

Each of bores 96 are designed to receive a compressor mounting bolt 106 having a hexagonal shaped head 107 at one end which is received within opening 104 and which projects outwardly from the upper surface 100 of mounting pad 94 and through a mounting foot 108 provided on the compressor. Preferably opening 104 will be closely sized to accommodate head 107 and may be designed to provide a friction fit therewith so as to retain bolts 106 and eliminate the need to apply a wrench to head 107 when securing compressor 12. Also, the friction fit enables the bolts to be inserted with the base member 10 inverted and retained therein while the base is turned over for assembly of the compressor thereto. A grommet 110 of a suitable elastomeric material such as rubber or a suitable synthetic material is interposed between foot 108 and surface 100 of mounting pad 94 which operates to resiliently support compressor 12 and prevent transmission of noise generating vibrations to base member 10. As shown, grommet 110 preferably includes an upwardly extending protrusion 111 extending through an opening in mounting foot 108. A nut 109 engages the threaded upper end of bolt 106 and is pretensioned so as to compress grommet 110 so as to resiliently secure compressor 12 to base 10. As best seen with reference to FIG. 7, upper surface 100 of compressor mounting pad 94 is disposed slightly below the plane defined by edge 23 of flange portion 22 and thus below the maximum condensate level so as to maintain the height of compressor 10 below a desired maximum. However, because grommet 110 is compressed against surface 100 of compressor mounting pad 94 due to the weight of compressor 10 and the pretensioning of nut 109, it also operates to effect a sealing relationship therebetween and effectively prevent any condensate leakage through openings 104. It should be noted that different size compressors may be easily accommodated by mounting pads 94 by merely providing the feet of the different sized compressor with a standard size bolt pattern.

An accessory mounting platform 112 is also provided being integrally molded on base 10 and extending inwardly from flange portion 22 and includes a raised surface 114 disposed in substantially coplanar relationship with edge 23 thereof. Bottom wall 20 is also cut out or open in the area defined by accessory mounting platform 112 so as to define a cavity 113 therein in which a plurality of reinforcing ribs 115 are provided. An opening 116 preferably of a non-circular shape such as square is also provided in platform 112 which is designed to accommodate mounting means associated with an accessory to be secured thereto. While as illustrated, accessory mounting platform 112 is shown as supporting receiver 18 which is secured to base 10 by a suitable threaded stud and nut, any other desired accessories such as valving or the like may alternatively be secured thereto. If desired, the accessory may include a non-circular or square projection receivable within opening 116 so as to prevent relative rotation of the accessory while a securing nut or bolt associated therewith is tightened.

In operation, moisture will be condensed from air being circulated across and cooled by the remotely located evaporator coils. It is generally not desirable to merely allow the condensate to drip from the evaporator coils. Accordingly, it is common practice to provide collection means for collecting this condensate which will include conduit means for draining it from the evaporator coils to a separate reservoir from which it may be allowed to evaporate or otherwise be disposed of.

In the present invention, base 10 provides an integral condensate reservoir to which the condensate is conducted which is of a size selected so as to insure sufficient capacity relative to the size of the largest capacity refrigeration system with which it is to be utilized to accommodate this condensate. The heat generated by operation of the compressor as well as the air circulation due to operation of the condenser fan will cause evaporation of the condensate collecting in the reservoir thereby eliminating the need to provide drain lines or periodically empty the reservoir.

The present invention also incorporates integral means by which this relatively cold condensate may be utilized to assist in the refrigeration cycle as well as hasten its evaporation from the reservoir. A plurality of relatively small spaced protrusions 117 are integrally formed on bottom 20 and extend upwardly therefrom. A pair of spaced bosses 118 are also integrally formed on bottom 20 each of which is provided with a relatively small diameter shallow opening 120 therein. Preferably openings 120 will not extend completely through bottom wall 20. The discharge conduit 122 extending from compressor 12 to condenser 16 is extended through the condensate reservoir in a generally serpentine fashion as shown extending transversely back and forth therethrough and between bosses 118 and selected pairs of protrusions 117. Conduit 122 is secured within the condensate reservoir by means of a hold down strap 124 disposed in overlying relationship thereto and secured to bosses 118 by means of screws 126 threadedly engaging openings 120. In order to prevent corrosion, strap 124 will preferably be fabricated from a suitable polymeric material and screws 126 will be either of a non-corrosive material or provided with a suitable corrosion preventing coating.

Thus, the condensate will operate to precool the refrigerant subsequent to compression and prior to passing the refrigerant through the condenser. Further, the heat of compression removed from the refrigerant will serve to warm the condensate and hasten its evaporation from the reservoir without requiring a separate heating means.

In order to secure supporting base 10 to a supporting rack, surface, or within apparatus with which it is to be utilized, a plurality of spaced bosses 128 are provided integrally molded therewith and extending to or above the maximum condensate level thereof. Each boss 128 is provided with a bore 130 extending therethrough which is adapted to accommodate suitable fasteners such as bolts or the like.

Thus, the present invention provides a compact non-corrosive mounting base to which a variety of refrigeration equipment may be easily secured so as to provide a convenient unitized package and which further incorporates a condensate reservoir therein. Further, the design of the mounting provisions enables the refrigeration equipment to be elevated above the condensate so as to prevent corrosion thereof while also incorporating provisions whereby the condensate may be utilized to assist the refrigeration cycle by precooling the refrigerant. Further, the base may be easily and inexpensively fabricated from any suitable polymeric material by a variety of methods such as injection molding, casting or the like and further may be easily cleaned. Also, the use of a polymeric material assists in dampening any noise generating vibrations resulting from compressor operation.

While it will be apparent that the preferred embodiment of the invention disclosed in well calculated to provide the advantages and features above stated, it will be appreciated that the invention is susceptible to modification, variation and change without departing from the proper scope or fair meaning of the subjoined claims.

I claim:

1. In a condenser unit including compressor means, associated condenser means and conduit means operatively connecting said condenser means to said compressor means, a supporting base formed from a polymeric material for supporting compressor means and said condenser means, said supporting base comprising:

a condensate receiving reservoir defined by a bottom and an upwardly extending peripheral flange portion:

integrally formed supporting means positioned below a portion of said condenser for supporting said condenser in overlying relationship to said reservoir portion, said supporting means including a platform having a substantially planar upper surface adapted to supportingly engage the lower surface of said condenser means, said surface being positioned at or above the maximum condensate level;

first securing means associated with said supporting means for securing said condenser means to said supporting means when said condenser means is less than a predetermined size;

second securing means associated with said supporting means and spaced outwardly from said first securing means for securing said condenser means to said supporting means when said condenser means is greater than said predetermined size;

integrally formed mounting means comprising a plurality of supporting protrusions extending upwardly from said bottom, each of said protrusions having an opening therethrough adapted to receive fastener means for securing said compressor to said base in overlying relationship to said reservoir, said bottom including a plurality of integrally formed reinforcing ribs disposed below said plurality of supporting protrusions;

said supporting means and said mounting means being operative to position said condenser and said compressor at or above the maximum condensate level of said reservoir.

2. A condenser unit as set forth in claim 1 wherein said protrusions are spaced below the upper edge of said peripheral flange portion and said mounting means further comprise elastomeric sealing means disposed between said compressor means and said protrusions.

3. A condenser unit as set forth in claim 2 wherein said elastomeric sealing means operates to resiliently support said compressor means on said protrusions so as to reduce transmission of noise generating vibrations therebetween.

4. A condenser unit as set forth in claim 1 wherein said opening includes means cooperable with said fastener means to prevent relative rotation of said fastener means with respect to said base.

5. A condenser unit as set forth in claim 4 wherein said rotation preventing means comprises an enlarged non-circular recess adjacent said opening and said fastener means comprises a threaded bolt having a non-circular head receivable within said non-circular recess.

6. A condenser unit as set forth in claim 4 wherein said fastener means are frictionally retained within said recess so as to enable said base member to be turned over without loss of said fasteners.

7. In a condenser unit including compressor means, associated condenser means and conduit means operatively connecting said condenser means to said compressor means, a supporting base formed from a polymeric material for supporting said compressor means and said condenser means, said supporting base comprising:

a condensate receiving reservoir defined by a bottom and an upwardly extending peripheral flange portion;

integrally formed supporting means positioned below a portion of said condenser for supporting said condenser in overlying relationship to said reservoir portion, said supporting means including a first platform having a substantially planar upper surface adapted to supportingly engage the lower surface of said condenser means; and a second platform spaced from said platform, said upper surfaces being positioned at or above the maximum condensate level;

first securing means associated with said supporting means for securing said condenser means to said supporting means when said condenser means is less than a predetermined size;

second securing means associated with said supporting means and spaced outwardly from said first securing means for securing said condenser means to said supporting means when said condenser means is greater than said predetermined size;

integrally formed mounting means for securing said compressor means to said supporting base in overlying relationship to said reservoir portion;

said supporting means and said mounting means being operative to position said condenser and said compressor at or above the maximum condensate level of said reservoir.

8. A condenser unit as set forth in claim 7 wherein said first securing means includes a pair of spaced openings provided in each of said upper surfaces, said openings being adapted to cooperate with fastener means for securing a condenser of a predetermined size.

* * * * *

UNITED STATES PATENT AND TRADEMARK OFFICE

CERTIFICATE OF CORRECTION

PATENT NO. : 4,471,633

DATED : September 4, 1984

INVENTOR(S) : Theodore E. Tinsler

It is certified that error appears in the above-identified patent and that said Letters Patent is hereby corrected as shown below:

Column 1, line 61, "recooling" should be -- precooling --.

Column 3, line 13, "6C" should be -- 60 --.

Column 6, line 13, after "supporting" insert -- said --.

Column 6, line 18, ":" should be -- ; --.

Column 6, line 39, after "opening" insert -- extending --.

Signed and Sealed this

*Twenty-sixth* Day of *February 1985*

[SEAL]

*Attest:*

DONALD J. QUIGG

*Attesting Officer* *Acting Commissioner of Patents and Trademarks*